United States Patent [19]

Bachman

[11] Patent Number: 4,526,098

[45] Date of Patent: Jul. 2, 1985

[54] LASER FORMED ROTARY PRINT PLATE WITH INTERNAL SINTERED TITANIUM INK RESERVOIR

[75] Inventor: Burl A. Bachman, Strongsville, Ohio

[73] Assignee: DL Process Co., Wheat Ridge, Colo.

[21] Appl. No.: 110,133

[22] Filed: Jan. 4, 1980

Related U.S. Application Data

[63] Continuation-in-part of Ser. No. 770,418, Feb. 22, 1977, abandoned.

[51] Int. Cl.[3] ..... B41F 15/04

[52] U.S. Cl. ..... 101/115; 101/170; 101/119; 101/128.4

[58] Field of Search ..... 101/115, 116, 125, 127, 101/128.2–128.3, 128.4, 129, 150, 151, 153, 163, 170, 395, 327, 328, 329, 401.1, 366, 367, 368, 202, 205, 206, 119, 120; 358/75; 346/76 L, 140 R

[56] References Cited

U.S. PATENT DOCUMENTS

| | | | |
|---|---|---|---|
| 2,401,220 | 5/1946 | Bonner | 101/127 X |
| 2,997,777 | 8/1961 | Davies | 210/510 X |
| 3,294,018 | 12/1966 | Heonis | 101/119 X |
| 3,363,552 | 1/1968 | Rarey | 101/127 |
| 3,368,482 | 2/1968 | Lusher et al. | 101/125 X |
| 3,587,459 | 6/1971 | Spencer | 427/143 X |
| 3,626,844 | 12/1971 | Priesmeyer | 101/125 X |
| 3,636,251 | 1/1972 | Daly et al. | 178/6.6 B |
| 3,696,742 | 10/1972 | Parts et al. | 101/128.4 |
| 3,746,540 | 7/1973 | Rarey | 101/128.3 X |
| 3,832,948 | 9/1974 | Barker | 101/395 |
| 3,890,896 | 6/1975 | Zimmer | 101/366 X |
| 3,921,520 | 11/1975 | Zimmer | 101/120 |
| 3,934,502 | 1/1976 | Marino | 101/116 |
| 3,934,503 | 1/1976 | Kinney et al. | 101/128.2 |
| 4,003,311 | 1/1977 | Bardin | 101/401.1 X |
| 4,103,614 | 8/1978 | Mitter | 101/119 X |

FOREIGN PATENT DOCUMENTS

| | | | |
|---|---|---|---|
| 2107738 | 8/1972 | Fed. Rep. of Germany | 101/128.4 |
| 2354323 | 5/1974 | Fed. Rep. of Germany | 101/150 |
| 2353197 | 5/1974 | Fed. Rep. of Germany | 101/150 |
| 156144 | 7/1932 | Switzerland | 101/119 |
| 360008 | 10/1931 | United Kingdom | 101/119 |

OTHER PUBLICATIONS

"Lasers in Plate Making" Albert Materazzi, Graphic Arts Monthly, Dec. 1975, pp. 70–74.

Colonial Catalog; 1970; p. 51; Section B, "Screen Fabrics".

*Primary Examiner*—E. H. Eickholt

*Attorney, Agent, or Firm*—Maky, Renner, Otto & Boisselle

[57] ABSTRACT

A method and apparatus for printing directly onto a surface employs a printing plate through which pigmented fluid passes directly onto such surface and a reservoir for supplying a highly uniform distribution of pigmented fluid preferably at a relatively accurately controlled pressure to the printing plate. A plurality of minute openings through the printing plate forming a printing image thereon controllably pass the pigmented fluid directly onto such surface. These openings may be tapered to reduce misting and to facilitate breaking surface tension as pigmented fluid is transferred directly to the surface. The reservoir may be a porous, permeable sintered titanium cylinder about which the printing plate is mounted. Moreover, the invention includes a method of forming such a printing plate employing optical, and preferably laser, scanning techniques so that the printing image on the printing plate accurately represents the original image.

9 Claims, 13 Drawing Figures

LASER FORMED ROTARY PRINT PLATE WITH INTERNAL SINTERED TITANIUM INK RESERVOIR

CROSS REFERENCE TO RELATED APPLICATION

This application is a continuation-in-part of co-pending application Ser. No. 770,418, filed Feb. 22, 1977, and now abandoned.

BACKGROUND OF THE INVENTION

The invention relates to a method of printing and to an apparatus for use in that method and, more particularly, the invention relates to the printing on an image directly from a printing plate onto a surface.

Presently there are four most commonly employed printing methods. In one, lithography, a flat-surfaced lithographic plate, which has image portions that hold ink and repel water and non-image portions that hold water and repel ink, transfers the ink to a blanket, e.g. a rubber-covered cylinder, and the blanket transfers the ink to a surface on which the image is to be printed. Hereinafter such a surface will be referred to as paper, although it will be appreciated that the image may be printed on other surfaces, as is well known in the art, and the image on the plate to be printed will be referred to as the printing image. Letterpress is another printing method in which the ink on raised surfaces of a metal plate defining the printing image thereon is transferred to the paper. In gravure printing, the ink is applied to the paper from hollows that are etched in the plate surface, and in screen-process printing ink is forced by a squeegee or the like through open areas in a screen onto the paper. The equipment for producing printed copy, especially at relatively high speeds, is relatively complex, bulky, expensive, and complicated to use to produce printed images of high fidelity, i.e. correspondence with the original copy.

Line copy is that type of printed image that ordinarily has no intermediate tones, and such line copy is produced by depositing a uniform amount of ink onto the paper by the printing surface wherever the latter bears a printing image; where there is no printing image, the paper remains clear so that the resulting line copy printed image is formed by the contrast between the clear or unprinted paper surface and the lines, type matter, dots, etc. printed thereon. To enhance tonal gradations from white to black or even from one color to another a halftone screen, for example, is merged with the original image on the original copy or with the printing image on the printing surface. The printed halftone image on the paper is formed of a plurality of black dots and white areas, where there is no image, as is well known. Moreover, copy with intermediate tones of grey is known as continuous-tone copy, and an image printed from copy will be similar to a halftone image but with same dots of various sizes effecting the more continuous tonal gradation. Halftone and continuous-tone printing usually produces printed images that have a grainy effect with boundaries that often do not correspond exactly with those of the original image and, accordingly, do not have a high degree of fidelity.

Color copy is printed using plural printing surfaces associated with respective dual printing cylinders, impression cylinders, and the like with complex inking and roller mechanisms to deliver ink of different respective colors. The printing of colors thus further increases the size of the printing equipment, and, for example, in the common method of magazine production, which employs such complex color printing equipment, massive ink dryers also are required. Also, since the different colors are printed at different locations a loss of fidelity may too easily occur. The distance between printing units affects reproduction fidelity by the constant changes occurring by the pressroom atmosphere and conditions affecting the quality of the ink formula and the exposure through a plurality of inking rollers from the ink reservoir to the printing plate surface.

A color mixing effect may be obtained when printing halftone and continuous-tone color copy by printing some of the localized dots in one color and some in another with the eye then mixing those dots, for example, combining a plurality of discrete blue and yellow dots that would appear visually as green. A disadvantage to printing color halftone and continuous-tone images is that the plurality of color dots are not all located exactly at the various boundaries of the original image and, therefore, fidelity is reduced. Moreover, in the color halftone printing process, a separate plurality of inking rollers and halftone printing surface screens are required at spaced-apart locations, of course, with each step away from the original copy there is a corresponding loss of fidelity.

Thus, the prior art printing methods require relatively large and complex equipment including presses with multiple printing units and compound inking systems, and a number of separate pieces of equipment are required to produce a negatives, halftones and plates as interim steps in the printing process from the original copy to the printed copy. Those printing methods are relatively expensive for both equipment and labor and are limited in the degree of true reproduction capability or fidelity.

As used herein, shade indicates a difference in color whereas tone means a difference in the lightness or darkness of a given color or of black to white, e.g. tones of gray.

SUMMARY OF THE INVENTION

In accordance with the method and apparatus of the present invention a relatively highly uniform distribution of pigmented fluid, such as a black, shade or colored pigment or colored pigmentation homogenized or blended into a carrier liquid, preferably a volatile carrier, quickly vaporizing or evaporating, e.g. alcohol, is supplied to a printing plate from a reservoir with a surface of permeable material that is the base and/or support of the printing plate, and the pigmented fluid is passed through a plurality of openings in the printing plate directly onto the paper or other surface to transfer a printed image thereon. The openings are arranged on the printing plate in a pattern to form the desired printing image that corresponds accurately to the original image, and preferably each opening is of relatively minute size to permit a relatively large number of them per relatively small unit area for maximum fidelity of the printed image.

The pigmented fluid may be provided through a sintered titanium metal reservoir, preferably made in the form of a hollow cylinder and having a porosity on the order to about the size of the minute openings, to assure a uniform supply to all the minute openings. Such a reservoir has a porosity factor on the order of, for example, about 5 microns which is satisfactory to assure that pigmented fluid applied to the hollow interior of the cylinder under a predetermined head or pressure will permeate therethrough, as in a metal filter, to form a relatively highly uniform distribution of pigmented fluid on the outer surface thereof. Moreover, in one embodiment, the cylindrical reservoir may be mounted and supported in an outer circumferential channel in an annular container to provide a containerized reservoir of reduced volume per printing surface area. The annular container which may be mounted between circular end plates to form a printing cylinder has at its ends circumferential grooves for receipt of annular seals which sealingly contact the edges of the printing plate mounted on the printing cylinder to prevent fluid leakage. In another embodiment, the cylindrical reservoir and container therefor may be formed of reservoir and container segments each of which is adapted to receive a different color pigmented fluid thereby to produce a multiple colored image onto the paper or other surface in a single stage operation. The segments may be clamped to a carrier cylinder or otherwise secured together to form the multiple color cylindrical containerized reservoir.

The printing plate preferably is a flexible membrane which is solid but for the minute openings therein and may be mounted and supported directly on the reservoir to receive a supply of pigmented fluid directly therefrom. Moreover, in one embodiment the openings through the printing plate have a tapered cross section, for example, of hourglass configuration, with an orifice or flow impediment interiorly thereof. Such impediments reduce misting when the reservoir and printing plate are rapidly rotated at high press speeds, facilitate breaking surface tension when the pigmented fluid is transferred onto the paper, maintain a back pressure behind the printing plate and/or in the reservoir to enable operation at relatively high head pressures, if desired, and the like.

The desired head pressure may be obtained by first filling the reservoir at a head pressure such as on the order of about 41 to about 53 lbs./sq. inch for a pigmented fluid having a viscosity on the order of about 1 to about 3.5 poise to ensure complete filling of the reservoir. During printing, the head pressure to the reservoir is increased about 1 to about 3 lbs./sq. inch depending on head pressure and fluid viscosity and then controlled or regulated in this range to obtain optimum image transfer. Without developed head pressure, the sintered metal reservoir may not properly transmit fluid which desirably and importantly prevents fluid transmission under gravity or centrifugal force thereby making printing relatively independent of printing cylinder orientation and dynamics.

The large number of openings per unit area of the printing plate and the uniform supply of pigmented fluid to them enable the printing of a printed image that has a high degree of fidelity preferably at a relatively low cost.

One further aspect of the invention includes a method of forming the openings in the printing plate in respective sizes and/or a distribution to form an accurate printing image representation of the original image on the original copy. This method employs a step of accurately optically scanning the original copy, for example at a scanning frequency or a modulated timing on the order of from 400 to 2000 vertical lines or more per inch with an ordinarily preferred range of 400 to 1000 lines per inch, and a further step of burning the respective openings in the printing plate using a laser beam programmed at similar line frequency of vertical distribution. The beam would be programmed to emit a burning beam at intervals of horizontal frequency equal to the vertical frequency lines forming an extremely fine or minute grid pattern. Similarly, a signal from the optical scanning mode would be modulated to an equal vertical line frequency distribution and/or modulated to control whether or not an opening is to be burned at a given location and/or the size of that opening. By varying the sizes of the openings the quantity of pigmented fluid passed therethrough may be varied correspondingly.

The prior art describes halftone or continuous-tone images as dots of various sizes effecting a continuous tonal graduation. Printing usually produces printed images that have a grainy effect with boundaries that often do not correspond exactly with those of the original photoprint copy and, accordingly, do not have a high degree fidelity of the original copy.

Another aspect of this invention, as a unique improvement over the prior art, is the elimination of the limited boundaries to tonal graduation from black to white inherent in the larger dot structure of the halftone. This may be obtained by a modular electronic timing of vertical and horizontal programming of the optical scanner and concurrently by a memory stored electronic impulse to a modularly controlled laser apparatus that correspondingly burns or perforates a printing plate at the precise location equal to the scanned copy.

The laser apparatus is a modularly controlled programmed device that is equally balanced to the vertical and horizontal timed signal or impulse received from the optical scanning program. The finely controlled frequencies produce a minute grid in a precise pattern of, for example, from 400 to 2000 lines per inch. The grid size is variable to enhance some printing or copy conditions. However, for example, if it were determined to program a 1000 lines to the inch grid to accurately represent a very fine original photographic copy, the vertical and horizontal frequency timing would be equally balanced between the precise optical scanning interpretation of a specific location on the copy and the laser burning or piercing method at an identically related precise location on the printing plate.

The laser beam would be controlled to vary the size of a burned hole or preforation so that each one of the small or minute grids would be a full grid pattern, e.g. that represents the largest opening, or within the perimeter of the grid, varying sizes of holes would be in direct relation to the signal strength of the optical scanner interpolations. Thus, an accurate printing image representation of the original image of the original copy is formed without a visible boundary of even the finest graduation of tones from black to white.

In accordance with another aspect of the invention, color printing is facilitated. The paper may be passed over a single impression cylinder that urges the paper to engagement with a plurality of printing cylinders, each including a respective reservoir containing a pigmented fluid of a respective color and a printing plate containing the openings distributed to form an image. The carrier fluid for the pigments preferably substantially instantly evaporates or dries upon transferral to the paper, and plural pigments may be applied by respective printing cylinders that are concentrically attached (mounted), to exactly the same dot location on the paper to generate a true mixed color of controlled shade and with the over-all image having a controlled tonal gradation. Thus, the ultimate printed image may have a coloring which is accurately indicative of that of the original image of an original color copy while also having an over-all high degree of fidelity.

With the foregoing in mind it is a principal object of the invention to facilitate the transferring of an image from one medium to another and preferably while maintaining the fidelity or correspondence of a printed image relative to an original image.

An additional object is to facilitate the transferring of an image to a printed plate.

A further object is to reduce the costs and complexities of printing.

Another object is to reduce misting, and/or leaking of pigmented fluid during high speed printing operations.

Still an additional object is to produce a printed image of high fidelity or correspondence to an original image directly from a printing plate.

Still a further object is to provide a relatively highly uniform distribution of pigmented fluid to a printing plate.

Still other objects are to facilitate color printing, to improve the accuracy of correspondence of printed color images with the colors of an original image, to improve the fidelity of printed color copy, and to provide multiple color printing in a single stage operation.

Even another object is to facilitate a method of forming a printing plate concentric to another object's surface to receive the image.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
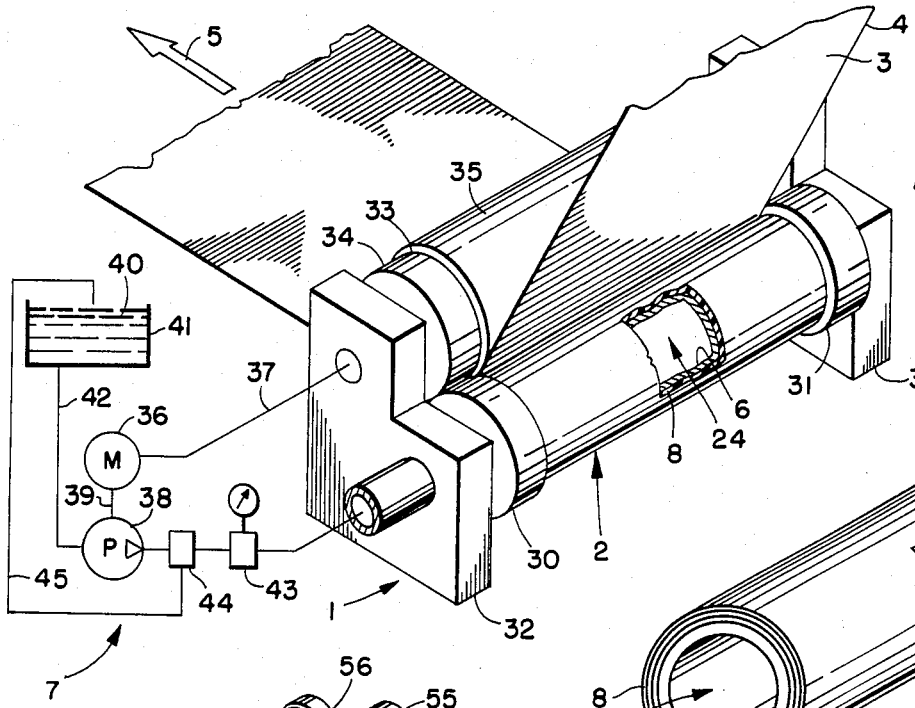
FIG. 1 is a schematic illustration of a printing press.

Referring in detail to the drawings, a printing press 1 employing a printing cylinder 2 in accordance with the invention and for use in practicing the method thereof is illustrated in FIG. 1. The printing press 1 is used to print a printed image directly onto the surface 3 of paper 4, which is drawn through the printing press by rollers, not shown, in the direction of the arrow 5. The printed image is printed on the surface 3 by transferring or passing directly to the latter a quantity of pigmented fluid from the printing cylinder 2. The pigmented fluid on the prining cylinder forms a printing image corresponding to an original image on original copy. Although the pigmented fluid may be conventional black or colored inks or the like, preferably a rapid drying type of pigmented fluid is used, such as, for example, a black or colored pigment in an alcohol carrier fluid. In operation of the printing press 1 pigmented fluid, which is delivered to the interior of the printing cylinder 2, is transferred directly onto the surface 3 to form the printed image thereon. Preferably, the fluids employed do not employ ground pigments since they would tend to clog the minute openings in the printing plate described below.

Figure 3:
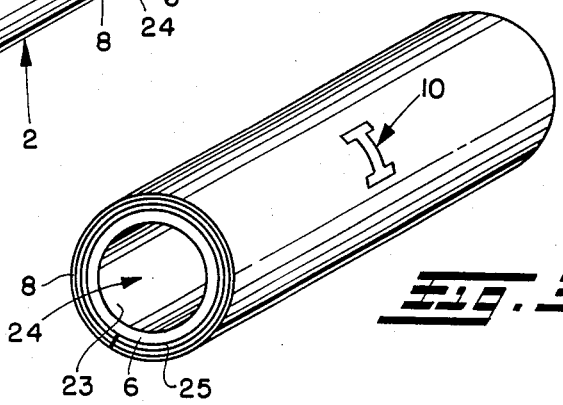
FIG. 3 is an enlarged view of a printing cylinder.
Figure 4:
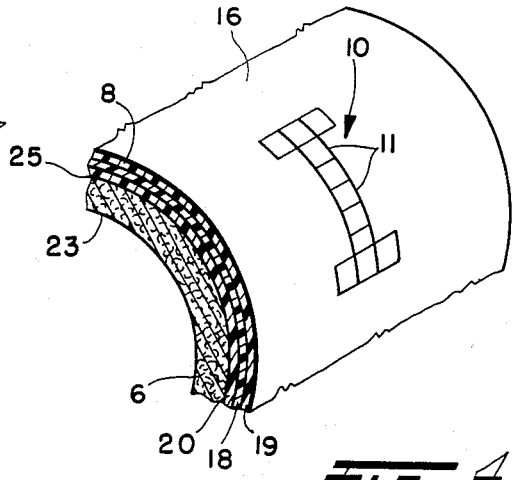
FIG. 4 is an enlarged fragmentary view partly broken away in section of the printing cylinder.

The printing cylinder 2, as shown in detail in FIGS. 3 and 4, includes a reservoir 6, which is provided with pigmented fluid from the fluid supply plumbing 7 of the printing press 1, and a printing plate 8. The reservoir 6 supplies a relatively highly uniform distribution of pigmented fluid to the printing plate 8, which is impermeable to the pigmented fluid. However, a plurality of minute openings, such as those designated at 9 in FIG. 5, for example on the order of about several thousandths or even ten thousandths of an inch across their widest open cross-section, through the printing plate 8 pass the pigmented fluid directly to the paper surface 3. Ordinarily a plurality of the openings 9 are grouped together or arranged in a grid pattern representative of the original image on the original copy to form the printing image of the printing cylinder. As the paper 4 is drawn through the printing press 1 and the printing cylinder 2 is rotated, the pigmented fluid in the openings 9 forming the printing image is transferred directly to the surface 3 to print the printed image thereon.

Since the reservoir is capable of supplying a highly uniform distribution of pigmented fluid to the printing plate 8 and since the printed image is printed directly by the printing plate, the size of the openings 9 may be extremely small relative, for example, to the openings ordinarily formed in a typical silk screen stencil. The reservoir 6 thus assures that substantially all of the minute openings in the printing plate 8 receive a substantially constant supply of pigmented fluid, with the actual quantity supplied to each being related to the dimensions of the respective openings, the fluid supply pressure and the rate of delivery to the surface 3.

As shown in FIG. 4 a plurality of minute openings are arranged in a pattern 10 to form a printing image in the shape of a letter "I", which for convenience of description is divided into blocks 11. If desired, each of the blocks 11 may represent a discrete minute opening through the printing plate 8. However, preferably each of the blocks 11 includes a plurality of discrete minute openings therein with the magnitude of the ratio of the area in each such block containing minute openings to the area thereof that remains solidly intact determining the actual quantity of pigmented fluid to be passed by such block and, thus, the ultimate tone of the printed image printed directly thereby.

Figure 6:
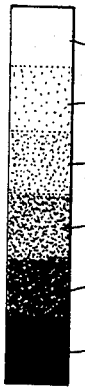
FIG. 6 is a representation of a typical gray tone guide from black to white.
Figure 7:
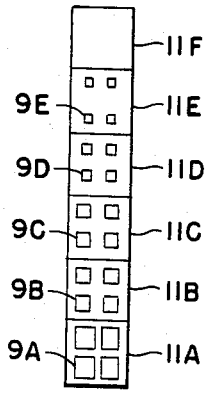
FIG. 7 is an enlargement of portions of a printing plate having different size openings to print the respective gray tones of FIG. 6.

To exemplify this tonal gradation effect, six respective tones of gray ranging from black to white are illustrated at 12A through 12F in FIG. 6. In FIG. 7 are illustrated portions 11A through 11F of blocks, such as those designated 11 in the printing plate 8 of FIG. 4, having minute openings 9A through 9E of different respective sizes to pass respective amounts of pigmented fluid to surface 3 to obtain such respective gray tones. In block portion 11F there are no minute openings so that the printing plate would be solidly intact and no pigmented fluid would be passed there. If all of the blocks 11 in the printing image pattern 10 of FIG. 4 has such large openings 9A as in block portion 11A of FIG. 7, a large quantity of pigmented fluid would be transferred from the printing image directly to the surface 3 to form a printed image that would appear to the eye as solid black, such as that shown at block 12A in the graduated tone guide of FIG. 6. Although the openings 9A are illustrated in relatively magnified form, preferably they would be of sufficiently small size so as to be indiscernible individually by the naked eye. Similarly, if the openings through the printing plate 8 at each of the blocks 11 in the printing image pattern 10 of FIG. 4 were relatively smaller, for example, like the openings 9C in block portion 11C, a relatively smaller quantity of pigmented fluid would be transferred to the surface 3 and the printed image would have a correspondingly lighter tone, such as that depicted at 12C in FIG. 6. Of course, if there were no openings in the blocks 11 of the printing image pattern 10, as represented by the block 11F of FIG. 7, then there would be no pigmented fluid transferred to the surface 3 and no printed image printed thereon.

Thus, by changing the sizes of the minute openings distributed on printing plate 8, a nearly infinite tonal gradation effect may be obtained in the printed image for maximum correspondence with the original image on the original copy. Moreover, since the openings in the printing plate are so small, the boundaries of the printed image also will correspond accurately with those of the original image. Accordingly, the printed image will have a high degree of fidelity.

In the preferred embodiment the reservoir 6 is a fluid filter comprised of sintered titanium metal, such as that disclosed in U.S. Pat. No. 2,997,777. Such material is fluid-permeable with respect to the pigmented fluid and is relatively strong and solid having a high permeability-to-porosity ratio, with permeability being intended to express the degree of interconnection between voids in the relatively porous filter. The porosity, that is, the size of the voids themselves, should be relatively small, for example, about five microns, further to assure uniformity of the distribution of pigmented fluid on the exterior surface of the reservoir from which such pigmented fluid is supplied directly to the respective openings in the printing plate 8 preferably to fill those openings.

The sintered titanium metal material is resistant to corrosion and plugging and may be readily back flushed for cleaning purposes. Moreover, such a reservoir of sintered titanium metal has a relatively smooth exterior surface that tends to induce a surface tension in the fluid film covering the same to reduce misting even during high speed rotation thereof.

It will be appreciated that the reservoir 6 may be formed of other materials that have satisfactory fluid-permeability and support characteristics to provide a satisfactory quantity and distribution of pigmented fluid from the interior or one side thereof through the material itself to the exterior surface thereof. Also, although the reservoir 6 preferably is a hollow cylinder with a printing plate 8 wrapped therearound for convenience of use in the printing press 1, it will be appreciated that the reservoir 6 may be formed in other shapes, such as a flat surface or a formed surface related to the shape of the surface intended to receive the printed image, having a supply of pigmented fluid delivered to one side thereof and supplying a flat printing plate located on the other side thereof and against which a paper surface or the like is urged to receive a printed image thereon.

The printing plate 8 itself should be impermeable to the pigmented fluid so the latter will be transferred to the surface only through the respective minute openings 9 through the printing plate. The printing plate material should be capable of having the openings 9 formed therein with reasonable facility and of maintaining those openings once formed and may be composed of a variety of plastic or plastic-like, metal, or other suitable materials, depending on the required hardness, flexibility, wear and fatigue, and like characteristics desired.

Figure 5:
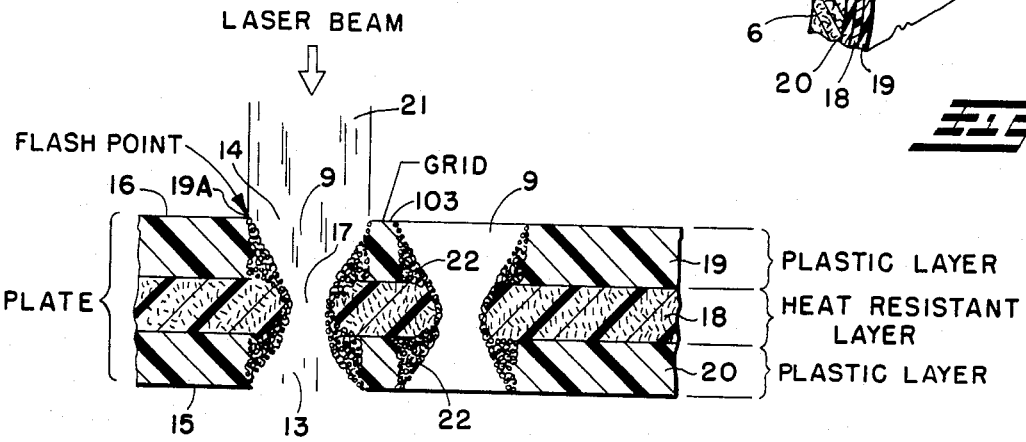
FIG. 5 is a fragmentary section view of a printing plate with a laser beam impinging thereon to burn respective openings therethrough.

Although the openings 9 through the printing plate 8 may be generally of rounded or square cylindrical configuration, an hourglass shape, as illustrated in FIG. 5, is preferable. Such tapered or hourglass shape openings 9 have relatively large cross-section pigmented fluid inlet and outlet areas or cavities 13, 14 at opposite ends, respectively, at the pigmented fluid receiving surface 15, which ordinarily is in abutment with the reservoir 6, and the printing surface 16 against which the paper surface 3 is urged during printing. Within the printing plate 8 the openings 9 are tapered to a relatively narrower cross-section orifice 17 that impedes the flow of pigmented fluid therethrough.

One technique for forming the openings 9 in the printing plate 8 is to burn through the printing plate with a laser beam. Such a laser beam of high intensity electromagnetic radiation (light) may have a small cross-section on the order of that desired for the openings 9. The heat produced by such a laser beam impinging on the printing plate 8 will burn through the printing plate to form the respective openings therein.

In this invention, the limited boundaries of tonal graduation from black to white inherent in the larger dot structure of the halftone are eliminated. This may be obtained by the modular electronic timing of vertical and horizontal programming of the optical scanner and concurrently by a memory stored electronic impulse to a modularly controlled laser apparatus that correspondingly burns or perforates a printing plate at the precise location equal to the scanned copy.

The laser apparatus may be a modularly controlled programmed device that is equally balanced to the vertical and horizontal timed signal or impulse received from the optical scanning program. The finely controlled frequencies produce a minute grid in a precise pattern of, for example, from about 400 or less, if desired, to 2000 lines per inch. The grid size is variable to enhance some printing or copy conditions. However, for example, if it were determined to program a 1000 lines to the inch grid to accurately represent a very fine original photographic copy, the vertical and horizontal frequency timing would be equally balanced between the precise optical scanning interpretation of a specific location on the copy and the laser burning or piercing method at an identically related precise location on the printing plate.

The laser beam would be controlled to vary the size of a burned hole or perforation so that each one of the small or minute grids would be a full grid pattern, e.g. that represents the largest openings, or within the perimeter of the grid, varying sizes of holes would be in direct relation to the signal strength of the optical scanner interpolations. Thus, an accurate printing image representation of the original image of the original copy is forming without a visible boundary of even the finest graduation of tones from black to white.

The printing plate 8, as illustrated in detail in FIG. 5, may comprise plural, for example three, layers 18, 19, 20 of plastic material laminated or otherwise secured together. The inner layer 18 preferably is formed of a plastic formula that is relatively more heat resistant than the outer layers 19, 20, which are sandwiched thereover. The layers 19, 20 may be formed of the same material that is of a formula which is relatively softer than the inner layer 18 and preferably contains heat congealing molecules. When the laser beam 21, for example, strikes the layer 19 at a flash point 19A on the surface 16 thereof, the opening 9 is formed as the heat is forced interiorly to the middle layer 18. The cross-section of the outlet area of the chamber 14 of the opening 9 where the laser beam 21 strikes the layer 19 will be approximately the same as that of the laser beam itself; but due to the relative heat resistant properties of the middle layer 18, the cross-section at the orifice 17 will be smaller. The heat passes further into the bottom softer layer 20 and congeals the molecules thereof to produce the relatively larger inlet area of the chamber 13 of the opening 9. The congealed molecules of the printing plate 8 bounding the openings 9 are generally indicated at 22. By modulating the laser beam 21, for example, by changing the intensity or the cross-section thereof, the sizes of the openings, i.e. the respective cross-sectional portions thereof, created by the laser beam may be correspondingly varied.

After all of the minute openings 9 of respective sizes have been formed in the printing plate 8 to complete the printing image, the printing plate is mounted on the reservoir 6. The pigmented fluid is delivered under pressure to the fluid input side 23 of the reservoir, for example, to the hollow interior 24 of the sintered titanium metal cylinder, so that pigmented fluid is thus forced to permeate therethrough to form a relatively highly uniform distribution on the exterior surface 25 to supply the openings 9 in the printing plate 8 preferably filling them. The orifice 7 of each opening serves as a gate or valve that allows a back pressure to develop in the reservoir 6 and/or at its interface with the printing plate surface 15.

Transfer of pigmented fluid from an opening 9 to the printed surface is achieved by pressing the surface 3 against the printing surface 16 to break the surface tension of the pigmented fluid across the outlet cavity 14 of the opening 9, and a quantity of the pigmented fluid then is absorbed by or clings to the surface 3. The orifice 17 acts as a fluid cut-off device to facilitate releasing the surface tension of the pigmented fluid between such orifice and the printing surface 16 for prompt passage directly to the surface 3 resulting in a release of such pigmented fluid and transfer to the surface 3 in a manner similar to that presently obtained in gravure printing.

The orifice 17 sets up or creates a back pressure so that it impedes or retards the refilling of the outlet cavity 14, thus preventing excessive fluid from spinning off as a mist from the rapidly rotating printing plate 8. The orifice 17 also reduces problems that may be caused by drying of ink in the outlet cavity, for example, as a blockage or cap over the reservoir fluid in case the fluid in the outlet cavity dries out or hardens when the printing cylinder 2 is inactive, thereby to avoid drying out of the reservoir cylinder 6 itself. Subsequent clean-out would be necessary, then, only to the orifice area 17 and of the outlet cavity 14. Moreover, to prevent drying of the rservoir over relatively long periods of time without removing the pigmented fluid therefrom, the pressure of the pigmented fluid may be stopped, and the outlet cavities 14 of the openings 9 may be cleaned and filled with a non-drying agent.

The size of the openings 9 or the orifices 17 or the line frequency at which those openings are formed in the printing plate is related to the porosity of the reservoir. Thus, the finer the porosity of the reservoir, the finer or more compact the gridwork of openings may be, i.e. the scanning line frequency may be increased.

Turning back to FIG. 1 now, the printing cylinder 2 is supported by a pair of cap holders 30, 31 for rotation relative to the frame 32 of the printing press 1. Preferably the cap holders 30, 31 are coupled to the printing cylinder 2 in fluid-tight relation to hold pigmented fluid within the reservoir 6. An impression cylinder 33 mounted in the press frame 32 includes metal cylinder or roller 34 and a resilient rubber or like material blanket 35 thereon that fits between the cap holders 30, 31 to urge the paper 4 against the printing plate 8. A motor 36 coupled by a drive linkage 37 rotates the impression cylinder 33 and the printing cylinder 2, for example via a gear train, not shown. The motor 36 also may be coupled to external mechanical devices, not shown, that draw the paper 4 through the printing press 1 in conventional manner such that the paper and the printing and impression cylinders all move in synchronism, for example, as in a typical web press.

In the fluid supply plumbing 7 a conventional pump 38, which may be driven by the motor 36 via a linkage 39, pumps pigmented fluid 40 from a storage tank 41 and supply line 42 to a conventional pressure regulator valve 43. The pressure regulator valve 43 preferably is adjustable to change the head pressure of the pigmented fluid it delivers to the interior 24 of the reservoir 6, for example, to control that pressure relative to the rotational speed of the printing cylinder 2 which in turn relates to the rate at which the pigmented fluid is transferred to the surface 3. A pressure relief valve 44 returns excess pigmented fluid from the pump 38 back through return line 45 to the storage tank 41.

For sintered metal reservoirs having a porosity of about 5 microns or the like, the desired head pressure may be developed by first filling the hollow interior 24 of the reservoir at a head pressure such as on the order of about 41 to about 53 lbs./sq. inch for a pigmented fluid having a viscosity on the order of about 1 to about 3.5 poise to ensure complete filling of the reservoir interior. After filling is complete, the head pressure is stepped up about 1 to 3 lbs./sq. inch depending on head pressure and fluid viscosity to force fluid through the porous reservoir to form an even film over the entire exterior surface 25 of the reservoir, and then coupled or regulated in this range to obtain optimum image transfer. Without developed head pressure, the sintered metal reservoir will not transmit fluid through the printing plate to the surface 3 absent substantial development of centripetal forces from high speed operation of the press.

More particularly, in utilizing the printing press 1 in the printing process, pigmented fluid is delivered from th fluid supply plumbing 7 to the interior 24 of the cylindrical reservoir 6. The pigmented fluid permeates to the exterior reservoir surface 25 under the developed head pressure to form a relatively highly uniform distribution of pigmented fluid thereon with such fluid supplying the respective openings 9 in the printing plate 8 preferably to fill the same. As the printing cylinder 2, impression cylinder 33, and paper 4 are moved synchronously, the pigmented fluid in the plurality of minute openings is passed directly to the surface 3 to print a printed image thereon.

In those instances that the size of the reservoir 6 is so great as to make it relatively impractical to fill the same with pigmented fluid, other means may be provided to effect internal distribution of pigmented fluid within the reservoir on its input side 23 so that the pigmented fluid on its exterior surface 25 is relatively uniformly distributed thereover. For example, concentric interior cylinders, or segmented areas or sections and the like may be placed within the hollow interior 24 of the cylindrical reservoir 6 to distribute the pigmented fluid therein and at least to an extent the force created as the reservoir is rotated may be controlled to urge the pigmented fluid through the reservoir to the exterior surface thereof.

Figure 2:
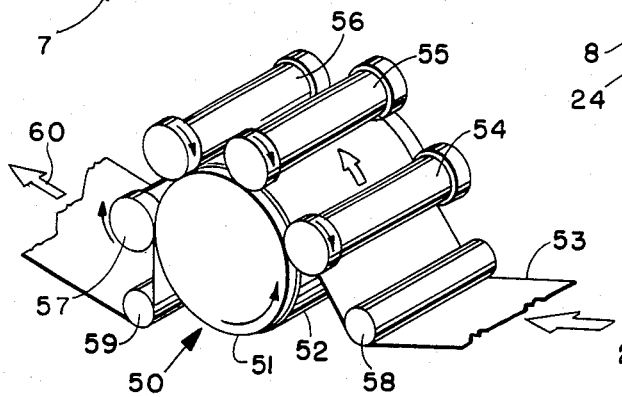
FIG. 2 is a schematic representation of part of a printing press for color printing.

In FIG. 2 a portion of a modified printing press 50 for printing multiple color images is illustrated. The printing press 50 includes an impression cylinder 51 having a resilient blanket 52 thereon for urging the paper 53 to abutment serially with respective printing cylinders 54 through 57. A pair of idler rollers 58, 59 guide the paper 53 as it is drawn through the printing press 50 in the direction indicated by arrow 60 in synchronism with the rotation of the impression cylinder 51 and the printing cylinders, all of which are driven by a motor and respective mechanical linkages, gear trains and the like, not shown. Each of the printing cylinders 54 through 57 is similar to the printing cylinder 2 and may be provided from a respective fluid supply plumbing mechanism, such as that shown at 7 in FIG. 1, with pigmented fluid of different respective colors.

As the paper 53 is drawn through the printing press 50, the first printing cylinder 54 prints a printed image of a first color thereon. Preferably the pigmented fluid transferred by the first printing cylinder 54 to an area of the paper 53 dries by the time that area reaches the second printing cylinder 55, which then prints a printed image of a second color onto the paper 53, and so on with regard to the other printing cylinders. In those areas of the ultimate printed image that are to have a color which is a combination of those respectively printed by plural printing cylinders, say the first and second printing cylinders 54, 55, respective minute openings in those two cylinders would be located at corresponding positions so that the two pigmented fluids are deposited at the same locations on the paper 53 to mix those colors directly on the paper. When such corresponding minute openings on the two printing cylinders 54, 55 are of the same size, the printed color may have equal amounts of the two pigments, say yellow and blue, to form a particular shade of green on the paper 53. However, by changing the relative sizes of those corresponding minute openings in the printing cylinders 54, 55, for example, the shade of the color printed on the paper 53 may be changed.

To print multiple colors generally the same steps as those employed during use of the printing press 1 may be followed. However, since the pigmented fluid is delivered internally of the respective printing cylinders 54 through 57 for transfer directly through the respective printing plates thereof to the paper 53, only a single impression cylinder 51 is required and the over-all multiple color printing press 50 may be significantly more compact and less expensive than prior art multiple color presses.

Figure 10:
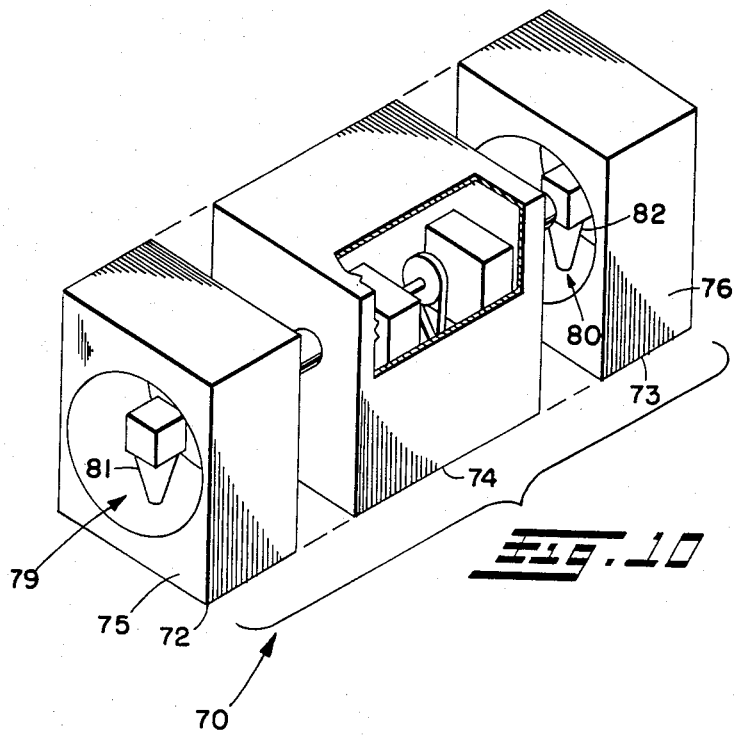
FIG. 10 is a schematic isometric view, partly broken away, of an optical scanner and recorder apparatus.
Figure 8:
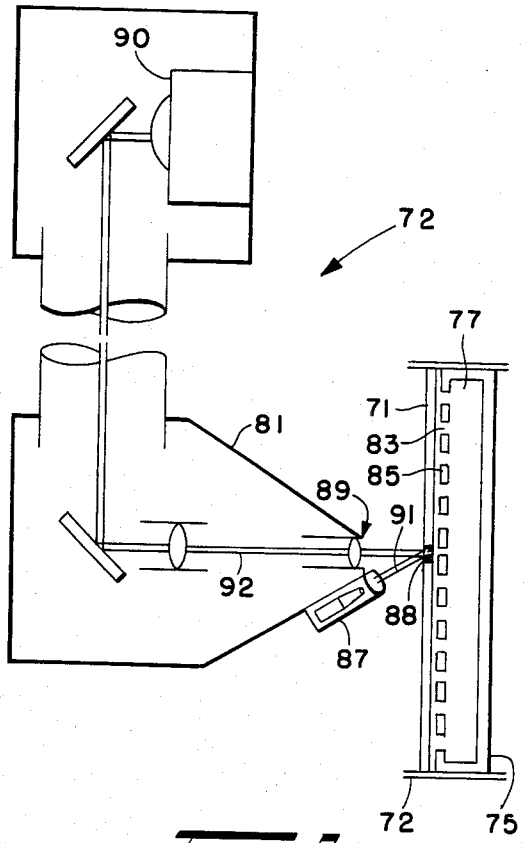
FIG. 8 is a schematic illustration of an optical scanner for reading the image on an original copy.
Figure 9:
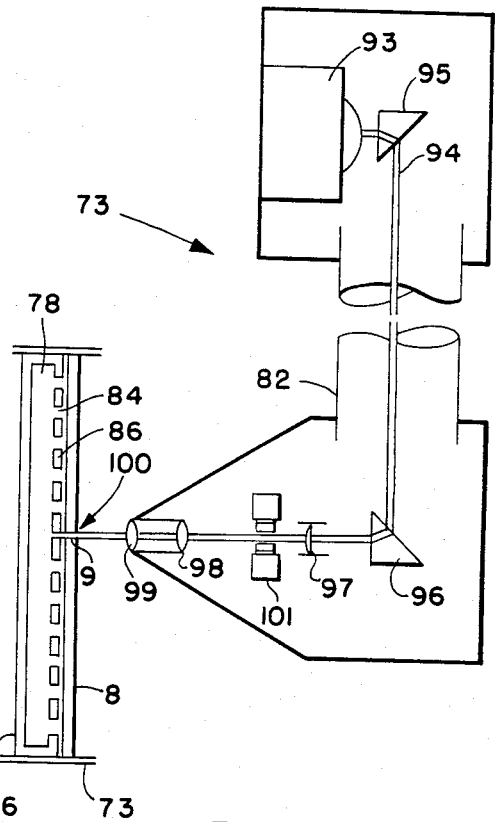
FIG. 9 is an illustration of a recorder for forming minute openings in a printing plate in accordance with the invention.

In FIGS. 8, 9 and 10 is illustrated an apparatus 70 for scanning an original copy 71 and transferring the original image thereon to a printing plate 8 in the form of a series of openings 9 therethrough collectively to form a printing image. The apparatus 70 includes an optical scanner 72, a recorder 73, and a programming control and/or drive mechanism 74. Each of the scanner 72 and recorder 73 includes a housing 75, 76 that contains a vacuum box 77, 78 for holding the original copy 71 and printing plate 8 in cylindrical openings 79, 80. Optical scanner head 81 and recorder head 82 are mounted in housings 75, 76. Conventional vacuum producing equipment, not shown, produces a vacuum in the vacuum boxes 77, 78 that operates through openings 83, 84 to draw the original copy 71 and the printing plate 8 securely against mounting plates 85, 86 circumscribing the cylindrical openings 79, 80. Thus, the vacuum boxes hold the original copy and the printing plate in a stable manner to assure perfect registry of the original image and the printing image during synchronized scanning by the optical scanner and recorder heads 81, 82. Also, the vacuum boxes tend to act as a heat sink with a continuous blanket of cool air circulating within the framework thereof to maintain both the original copy and the printing plate relatively cool during the scanning and recording process.

The mechanism 74 includes a motor that drives the respective optical scanner and recorder heads 81, 82 in identical patterns to effect scanning of the original image on the original copy 71 and recording of the printing image in the form of a plurality of minute openings 9 in the printing plate 8. The scanning pattern may follow a plurality of closely spaced lines generally parallel to the longitudinal axis of the respective housing openings 79, 80 and separated, for example, by several thousandths inch or may be in a generally circular or helical direction, like a screw thread pattern, generally circumferentially about the respective housing openings with similar spacing between the nearly circular lines thereof, with the recorder being accodingly operable to form the desired grid of the printing plate. The mechanism 74 may include computer control circuitry or the like to effect such precise scanning and recording and, additionally, to monitor the information produced by the optical scanner 81 and in response thereto to control the recording operation of the recorder 82.

The optical scanner 81 may be a conventional optical scanning device having a source of illumination 87 that illuminates relatively small discrete areas 88 on the original copy 71 and a photosensitive pick-up 89 with lenses and reflectors that direct light reflected from the area 88 to a conventional single or multi-cell photosensor 90. The photosensor 90 produces quantified information as an electrical output signal indicative of the intensity of the light reflected from the discrete area 88, as is well known, and the combination of electrical signals produced by the photosensor will be indicative of the light and dark areas, respectively, of the original image on the original copy 71. As is also well known, if desired, selected color filters, prisms, or other color separating devices may be interposed in the incident light beam 91 from the light source 87 and/or in the path of the reflected light beam 92 from the area 88 so that the electrical signals produced by the photosensor 90 will be indicative of the respective colors of light reflected by the original image. The electrical signals produced by the photosensor 90 are delivered to the mechanism 74 which responds to those electrical signals to control the recorder 82.

The recorder 82 may include a conventional laser 93 which produces a high intensity light beam 94 that is directed by prisms 95, 96 and lenses 97, 98, 99 to discrete areas, such as the area 100, on the printing plate 8 to burn respective openings 9 therein. As indicated, the mechanism 74 ordinarily would provide control of the recorder 82 to determine the respective locations at which the laser beam 94 impinges onto the printing plate relative to the position of the optical scanner 81. Moreover, the mechanism 74 also may control a conventional adjustable mechanical diaphragm modulator 101 or the like, such as electronic, acoustical or like optical modulators, to change, i.e. to modulate, the intensity or cross-section of the laser beam that impinges onto the printing plage 8 thereby to vary the sizes of the respective openings burned therein. The mechanism 74, accordingly, may include conventional circuitry that responds to the electrical outputs of the photosensor 90 as discrete areas 88 on the original copy 71 are scanned and that produces respective control signals indicative of such electrical outputs to operate the modulator 101 for modulating the laser beam 94 thereby to determine whether a minute opening 9 is to be burned into the printing plate 8 at respective discrete areas 100 thereof and, if so, the size of such opening. The lighter or brighter areas on the original copy ordinarily cause a larger output from the photosensor than darker areas. Correspondingly, larger or smaller minute openings are formed in the printing plate for passing relative amounts of pigmented fluid to the surface 3 depending on the photosensor output.

One laser system for scanning original copy and recording optical impressions or exposures on a printing plate or the like for use as the apparatus 70 is manufactured and sold by EOCOM Corporation, Irvine, Calif., under the name Laserite 100F, as is described in *Graphic Arts Monthly,* January, 1976, at pages 42–44. Other laser devices for use in scanning and read-out systems for graphic arts are also described in *Graphic Arts Monthly,* December, 1975, at pages 30–33.

Using the apparatus 70 to scan original copy and to produce a printing image on a printing plate 8, the maximum size of the minute openings 9 are burned through the printing plate ordinarily will be a function of the intensity and/or cross-section of the laser beam impinging thereon. The maximum size, e.g. diameter, of those minute openings should be slightly less than the average distance between respective scan lines so that a gridlike network of ribs, such as those indicated at 103 in FIG. 5, is formd on the printing plate to maintain a separation between adjacent openings. Moreover, adjacent openings or respective central axes thereof along a common scan line preferably are similarly spaced apart for uniformity in the distribution of the openings in the printing plate.

Thus, in carrying out one method of the invention an original copy 71 is optically scanned and depending on the optical characteristics of discrete areas of the original image correspondingly sized minute openings are optically recorded in the printing plate 8.

Figure 11:
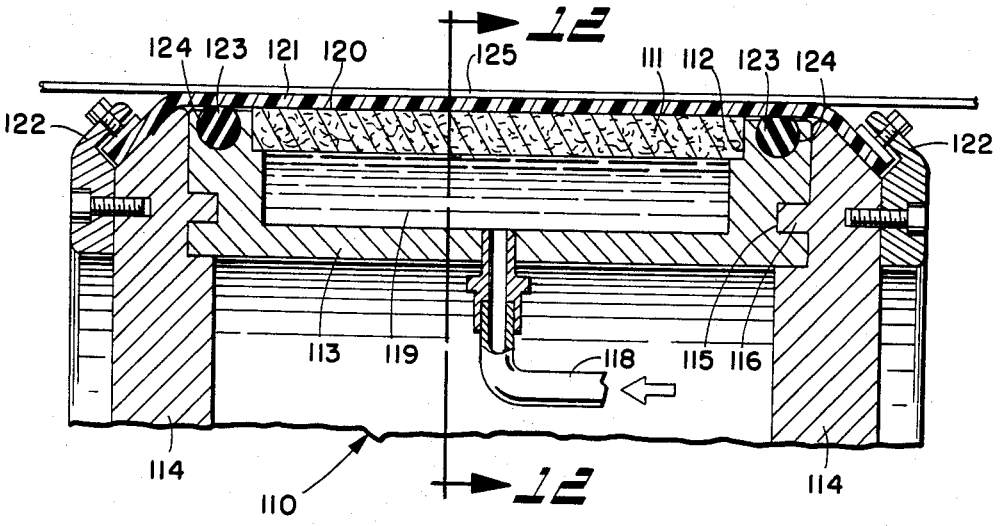
FIG. 11 is a fragmentary axial section of another form of printing cylinder according to the invention.
Figure 12:
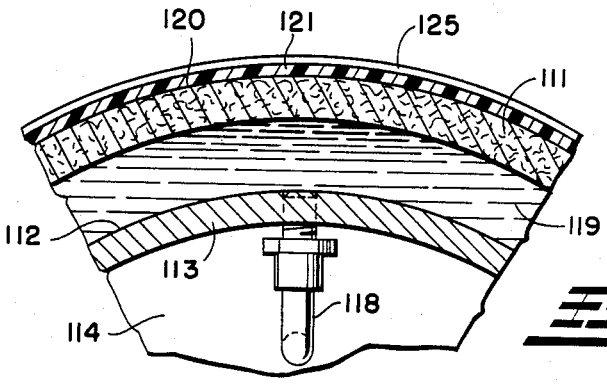
FIG. 12 is a fragmentary radial section of the printing cylinder of FIG. 11 taken along the line 12—12 thereof.

Referring now to FIGS. 11 and 12, another form of printing cylinder for use in accordance with the invention is designated generally by reference numeral 110. The printing cylinder 110 consists of cylindrical reservoir 111 which is mounted and supported in an outwardly opening circumferential channel 112 in an annular container 113 which may be mounted between a pair of circular end plates 114. The axially inner face of each end plate 114 is recessed at its radially outer edge for receipt of the ends of the container 113, and each end of the container has an annular groove 115 for receipt of an annular flange 116 in the recess of each end plate thereby to interlock the container and end plates. Each end plate 114 may be concentrically mounted on a shaft (not shown) for rotation therewith, which shaft may be adapted for mounting the printing cylinder 110 in a printing press for use therein such as in the manner illustrated and described above.

The reservoir 111 is a rigid, fluid-permeable material such as sintered titanium metal. Such material is relatively strong and should have a high permeability-to-porosity ratio with respect to pigmented fluid. The sintered metal reservoir together with the container 113 define a containerized reservoir for the pigmented fluid received therein under controlled pressure through fluid supply line 118. The supply line 118 is connected to the container 113 at the radially inner surface thereof which has an inner diameter sufficient to accommodate any additioal plumbing required. Fluid from the supply line is fed initially into the radially inner portion 119 of channel 112 and then into and through the sintered metal reservoir 111.

The radially outer surface of the sintered metal reservoir 111 is preferably substantially flush with the radially outer surface of the container 113 at the ends thereof thereby to define a cylindrical support surface 120 on which is mounted a printing plate 121 previously formed in accordance with the invention, it of course being understood that the size and line frequency of the openings formed in the printing plate is related to the porosity of the reservoir as discussed above. The annular edges of the printing plate 121 are secured to the printing cylinder by clamps 122 at the outer radial edges of th end plates 114. A pair of annular seals such as O-rings 123 are provided in suitably dimensioned grooves 124 in the outer axial surface of the container 113 at its axial ends so that the O-rings 123 project slightly beyond the outer surface of the container to contact sealingly the inner surface of the printing plate at its ends thereby to prevent leakage of pigmented fluid axially between the printing plate and container. Therefore, during operation, pigmented fluid flows from the reservoir only through the perforations in the plate when contacted by a substrate 125 being printed.

Figure 13:
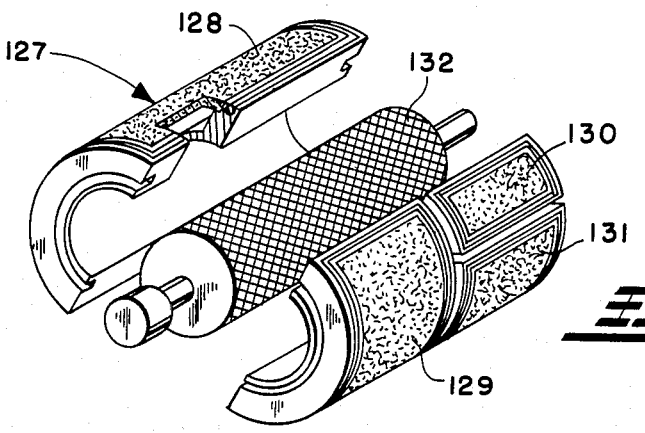
FIG. 13 is an exploded schematic illustration of still another form of printing cylinder for single-stage multiple color printing.

In FIG. 13, a modified printing cylinder 127 for printing multiple color images in a single stage operation is shown. The printing cylinder 127 is similar to above-described printing cylinder 110 but is divided into a plurality of segments 128–131 each of which is self-contained for receipt of pigmented fluid under pressure, there being provided as illustrated suitable seals in the respective printing plate support surfaces of the segments to prevent intermixing of pigmented fluids between the segments. The segments may extend fully or partially circumferentially around the cylinder and/or fully or partially axially the width of the printing cylinder 127, and may be clamped or otherwise secured together preferably on a carrier cylinder 132 to form together a cylindrical support surface for a printing plate. The carrier cylinder 132 may be provided with suitable plumbing for supplying under pressure different colored pigmented fluids to the segments.

By supplying a different color pigmented fluid to each segment, a multicolored image may be printed witha single perforated printing plate wrapped around the multi-segmented printing cylinder. As shown, the cylinder includes the semi-cylindrical segment 128 extending the full axial width of the cylinder, semi-cylindrical segment 129 extending from one end half the axial width and two other segments 130 and 131 which complete the cylinder. Accordingly, a substrate could be printed having the entire top half printed in one color, the bottom left half printed in another color, and the bottom right half further divided into sections of still different colors, all in a single stage operation employing a single perforated printing plate.

Although the invention has been shown and described with respect to certain preferred embodiments, it is obvious that equivalent alterations and modifications will occur to others skilled in the art upon the reading and understanding of this specification. The present invention includes all such equivalent alterations and modifications and is limited only by the scope of the claims.

The embodiments of the invention in which an exclusive property or privilege is claimed are defined as follows:

1. In a high speed rotary printing press for reproducing an image on a substrate, the combination of a porous reservoir for pigmented fluid having at least one porous surface, a printing plate mounted and supported by said reservoir and cooperating therewith, said printing plate having a plurality of spaced minute openings therein to form the image on the substrate by transfer of pigmented fluid from said minute openings directly to the substrate when the latter contacts said printing plate, said minute openings being arranged in a grid pattern on said printing plate to define the shape and density of the image, means for supplying under controlled pressure pigmented fluid to said porous reservoir for passing pigmented fluid to said minute openings for transfer therefrom directly to the substrate, said one porous surface of said reservoir comprising a section of a cylinder, said pigmented fluid being supplied in the hollow interior thereof, said printing plate comprising a relatively flexible material for mounting the same on the cylindrical porous surface said reservoir comprising a material forming said one porous surface that is permeable to such pigmented fluid, said material delivering a highly uniform distribution of pigmented fluid throughout the entire porous surface thereof to said printing plate for passage through said minute openings directly onto a surface for printing an image thereon, said reservoir comprising sintered titanium metal having a porosity on the order of about the size of said minute openings.

2. In a printing press for reproducing an image on a substrate, the combination of a rigid porous reservoir for pigmented fluid having at least one porous surface, a printing plate mounted on and supported by said reservoir and cooperating therewith, said printing plate having a plurality of minute openings therein to form the image on the substrate by transfer of pigmented fluid from said minute openings directly to the substrate when the latter contacts said printing plate, said minute openings being arranged in a pattern on said printing plate to define the shape of the image, and means for supplying under controlled pressure pigmented fluid through said minute openings for transfer therefrom directly to the substrate, which minute openings are tapered and of hour glass shape, said printing plate comprising plural layers of plastic-like material, an inner layer thereof being relatively more heat resistant than outer layers on opposite sides thereof.

3. In a printing press for reproducing an image on a substrate, the combination of a rigid porous reservoir for pigmented fluid having at least one porous surface, a printing plate mounted and supported by said reservoir and cooperating therewith, said printing plate having a plurality of minute openings therein to form the image on the substrate by transfer of pigmented fluid from said minute openings directly to the substrate when the latter contacts said printing plate, said minute openings being arranged in a pattern on said printing plate to define the shape of the image, and means for supplying under controlled pressure pigmented fluid to said porous reservoir for passing pigmented fluid through said minute openings for transfer therefrom directly to the substrate, which reservoir is cylindrical and has an inner and outer surface, said outer surface forming said one porous surface, and the pigmented fluid being supplied to said inner surface, and further comprising an annular container having annular end portions defining an outwardly opening annular groove therebetween, and wherein said rigid porous material is mounted in said groove with said one surface flush with said end portions, and further comprising an annular seal at each end portion in sealing contact with said plate thereby to prevent leakage of pigmented fluid between said plate and said end portions of said container.

4. The press of claim 3, comprising a pair of end plates between which said annular container is mounted to form a printing cylinder, and said plate is wrapped around said printing cylinder and clamped along its annular edges to said cylinder.

5. In a printing press for reproducing an image on a substrate, the combination of a rigid porous reservoir for pigmented fluid having at least one porous surface, a printing plate mounted on and supported by said reservoir and cooperating therewith, said printing plate having a plurality of spaced minute openings therein to form the image on the substrate by transfer of pigmented fluid from said minute openings to the substrate when the latter contacts said printing plate, said minute openings being arranged in a grid pattern on said printing plate to define the shape and density of the image, and means for supplying under controlled pressure pigmented fluid to said porous reservoir for passing pigmented fluid through said minute openings for transfer therefrom directly to the substrate, said reservoir delivering a highly uniform distribution of pigmented fluid throughout the entire porous surface thereof to said printing plate for passage through said minute openings directly onto a surface for printing image thereon, said reservoir comprising sintered titanium metal having a porosity on the order of about the size of said minute openings.

6. In a printing press, a support and pigmented fluid supply for a printing plate having a plurality of minute openings therein to form an image on a substrate by transfer of pigmented fluid through said openings directly to the substrate when the latter contacts the printing plate, said support and pigmented fluid supply comprising a rigid porous reservoir for pigmented fluid having at least one porous surface on which the printing plate can be supported and means for supplying under controlled pressure pigmented fluid to said reservoir, which reservoir is cylindrical and has an inner and outer surface, said outer suface forming said one porous surface, and the pigmented fluid being supplied to said inner surface, and further comprising an annular cylinder having annular end portions defining an outwardly opening annular groove therebetween, and wherein said rigid porous material is mounted in said groove with said one surface flush with said end portions, and further comprising an annular seal at each end portion in sealing contact with said plate thereby to prevent leakage of pigmented fluid between said plate and said end portions of said cylinder.

7. The press of claim 6, comprising a pair of end plates between which said annular container is mounted to form a printing cylinder, and means to clamp the plate wrapped around said printing cylinder along its annular edges to said cylinder.

8. The press of claim 7, wherein said reservoir is formed from a plurality of cylinder segments each of which is adapted to receive a different color pigmented fluid thereby to produce a multiple colored image on the substrate.

9. The press of claim 6, wherein said segments are mounted on a carrier cylinder therefor to form a printing cylinder around which can be wrapped the plate.

* * * * *